US005662447A

United States Patent [19]

Tsai

[11] Patent Number: 5,662,447

[45] Date of Patent: Sep. 2, 1997

[54] FRONTCOVER MOUNTABLE WITH A PHOTOGRAPH FOR BOOKS AND ITS MANUFACTURING METHOD

[75] Inventor: B. H. Tsai, Tainan, Taiwan

[73] Assignee: Jiun Wey Industrial Co., Ltd., Tainan, Taiwan

[21] Appl. No.: 519,348

[22] Filed: Aug. 25, 1995

[51] Int. Cl.[6] ..... B42D 3/08

[52] U.S. Cl. ..... 412/1; 412/3; 281/31; 281/22; 281/29; 40/726; D19/26; D19/32

[58] Field of Search ..... 281/31, 22, 36, 281/37, 51, 15.1, 29; 40/726, 537, 775; D19/26, 27, 33; 412/1, 3; 446/147, 149

[56] References Cited

U.S. PATENT DOCUMENTS

| | | | |
|---|---|---|---|
| 32,287 | 5/1861 | Grumel | 40/775 X |
| 35,310 | 5/1862 | Griggs | 40/775 |
| 36,011 | 7/1862 | Matthews | 40/775 X |
| 91,728 | 6/1869 | Eastman | 40/775 X |
| 143,878 | 10/1873 | Catersib | 40/775 |
| 170,042 | 11/1875 | Anthony | 281/22 |
| 764,441 | 7/1904 | Engel | 281/22 X |
| 2,453,902 | 11/1948 | Graham | 40/752 |
| 2,542,754 | 2/1951 | De Vry | 281/22 X |
| 2,801,115 | 7/1957 | Federbush et al. | 281/31 |
| 2,850,294 | 9/1958 | Ortis et al. | 40/726 X |
| 2,852,275 | 9/1958 | Brook | 40/726 X |
| 2,889,646 | 6/1959 | Matthias et al. | 40/775 |
| 3,174,244 | 3/1965 | Walton | 40/124.1 X |
| 3,545,115 | 12/1970 | Nichols | 40/750 |
| 3,869,820 | 3/1975 | Holson | 40/705 |
| 3,885,336 | 5/1975 | Olsen | 40/775 X |
| 4,140,565 | 2/1979 | Parker et al. | 281/22 X |
| 4,164,085 | 8/1979 | Steeb et al. | 40/726 |
| 4,356,652 | 11/1982 | Schneider | 40/530 |
| 4,450,638 | 5/1984 | Bader | 40/774 |
| 4,601,489 | 7/1986 | Stancato | 281/22 X |
| 4,780,975 | 11/1988 | Friedman | 40/755 |
| 4,822,195 | 4/1989 | Lu | 402/53 |
| 4,830,404 | 5/1989 | Lu | 281/29 X |
| 5,186,496 | 2/1993 | Seki | 281/22 X |

*Primary Examiner*—Frances Han

*Attorney, Agent, or Firm*—Morton J. Rosenberg; David I. Klein

[57] ABSTRACT

A frontcover mountable with a photo for books is made of two layers of hard board, having an opening in an outer layer. A cover paper having an opening corresponding to the opening of the outer layer of the hard board is adhered on an outer surface of the outer layer, with one side unadhered to allow a photo inserted through a gap between the both to expose out of the opening. Its manufacturing method includes eight steps.

1 Claim, 5 Drawing Sheets

FRONTCOVER MOUNTABLE WITH A PHOTOGRAPH FOR BOOKS AND ITS MANUFACTURING METHOD

This invention concerns a frontcover for books, particularly able to mount a photograph or the like, and its manufacturing method.

Nowadays common books have a frontcover printed with a design or have an extra cover paper added on the frontcover. They are very commonplace, unable to arouse curiosity of users.

SUMMARY OF THE INVENTION

This invention has been devised to offer a kind of frontcover mountable with a photo, picture or the like, to give a book a unique impression.

A frontcover mountable with a photograph for books in the present invention is formed with two layers of hard board folded with half on half, and one half is cut off an opening and the other half is adhered with a beautiful background paper on an inner side. Then a cover paper printed with a design is also cut off an opening corresponding to that of the half of the hard board and then adhered on an outer surface of the half, leaving one side unadhered to allow photograph to be inserted through an entrance gap between the cover paper and the half of the hard board to expose out of the opening.

BRIEF DESCRIPTION OF DRAWINGS

This invention will be better understood by reference to the accompanying drawings, wherein.

DESCRIPTION OF THE PREFERRED EMBODIMENTS

Figure 1:
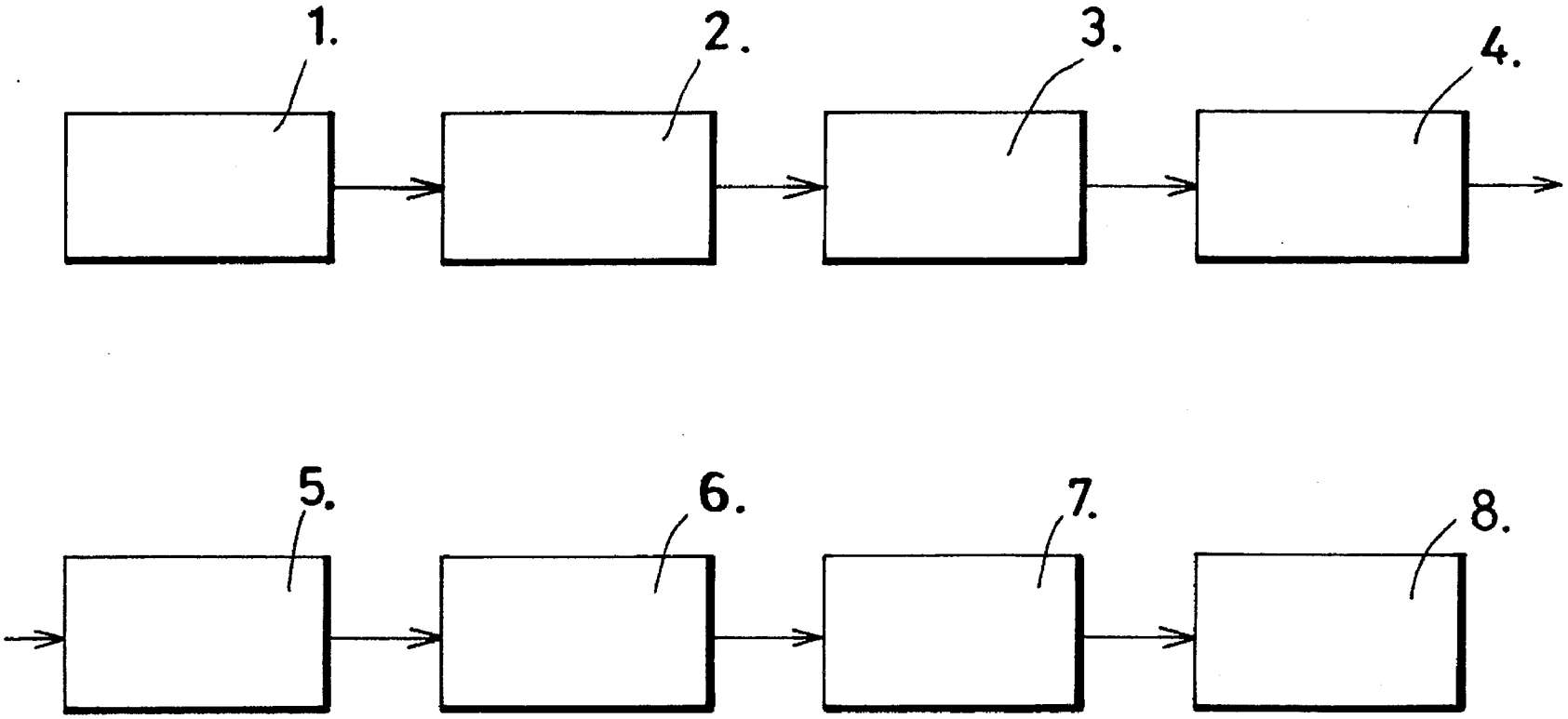
FIG. 1 is a flow chart of this invention.
Figure 2:
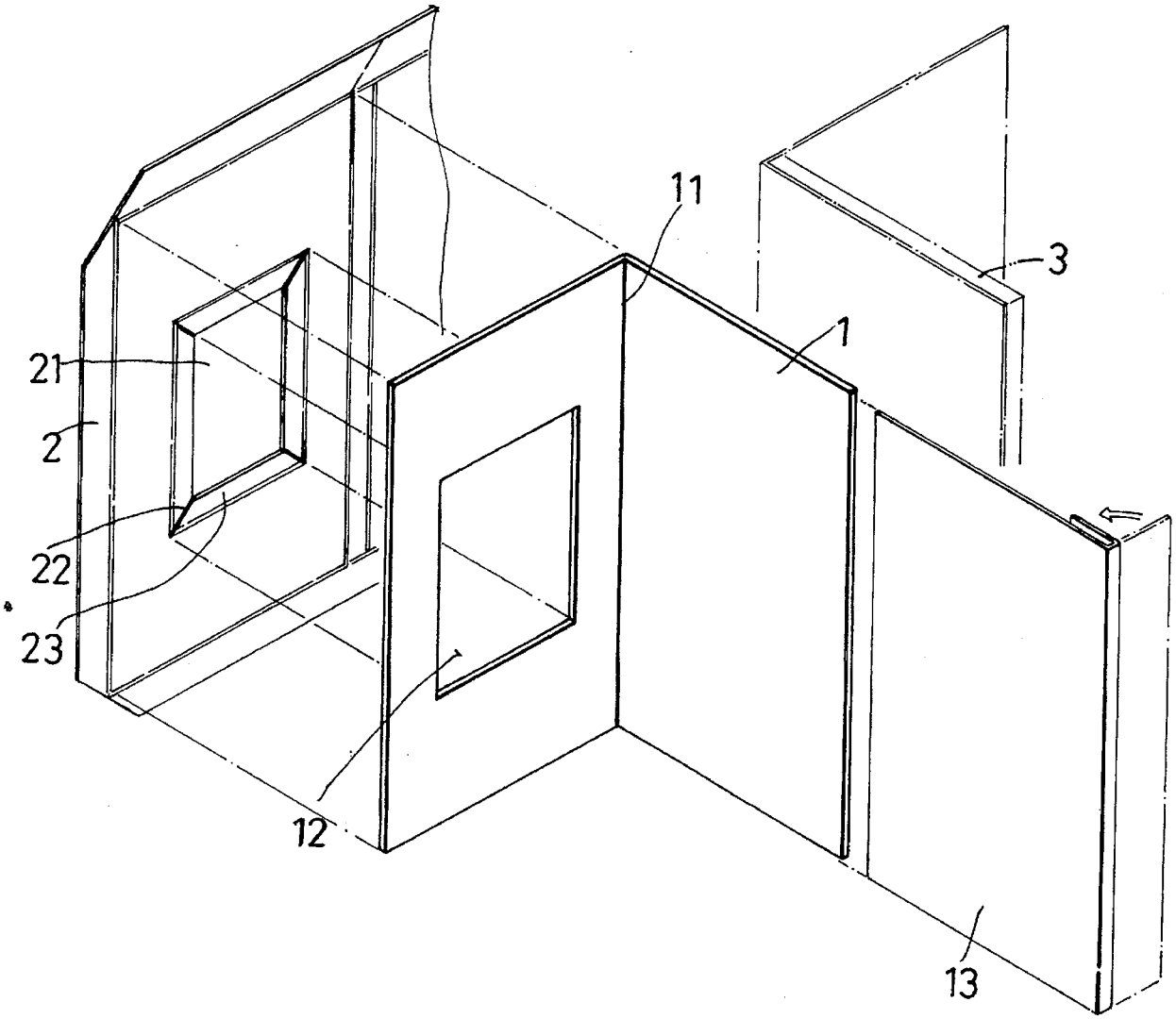
FIG. 2 is an exploded perspective view of a first embodiment of a frontcover mountable with a photograph for books in the present invention.
Figure 4:
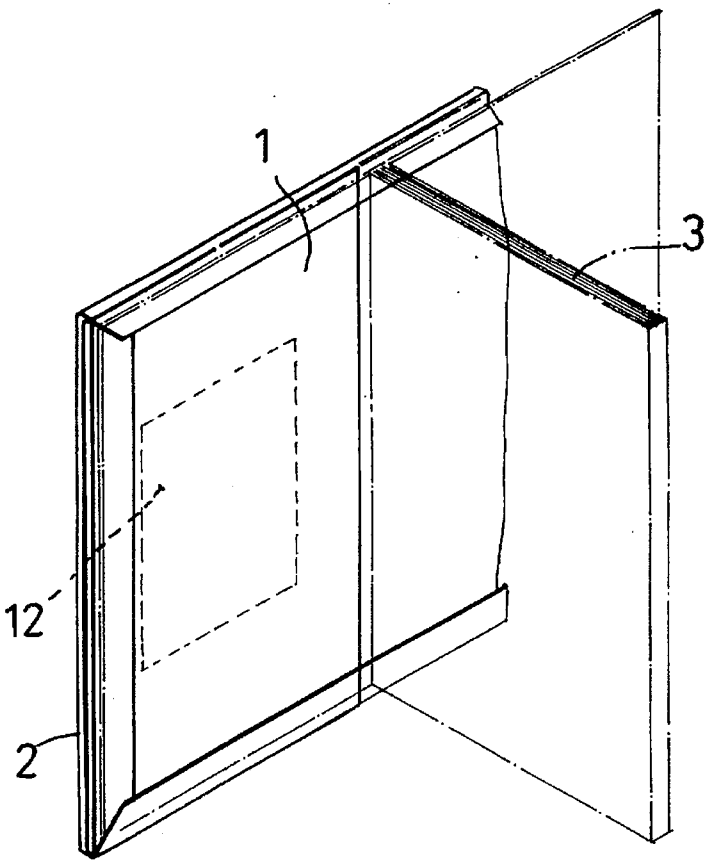
FIG. 4 is a perspective view of the first embodiment of a frontcover mountable with a photograph in the present invention, showing it used in a book.
Figure 3:
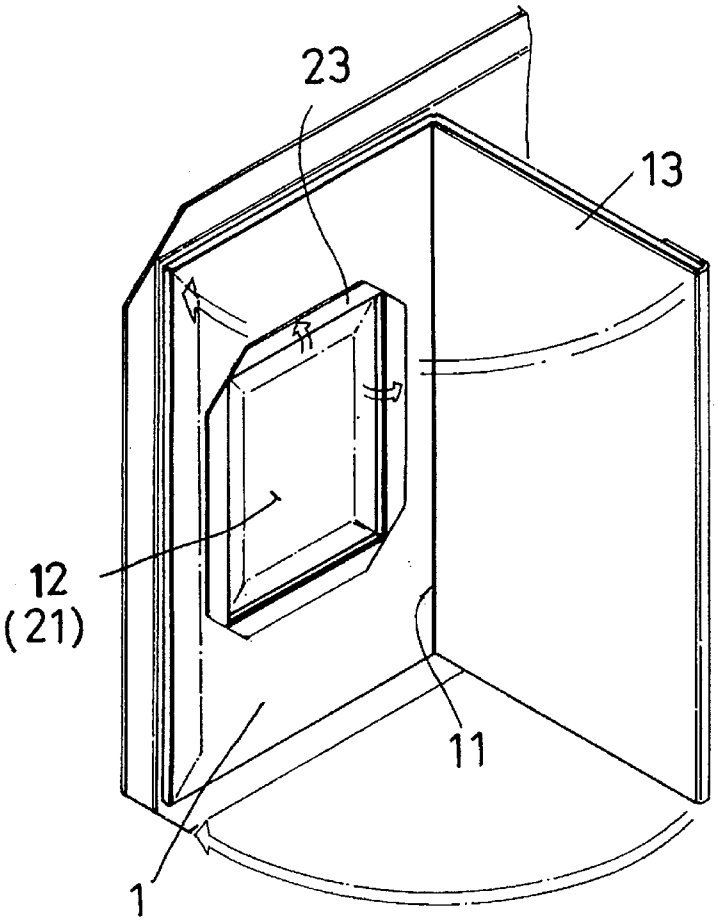
FIG. 3 is a perspective view of the first embodiment of a frontcover adhered with a cover paper in the present invention.
Figure 5:
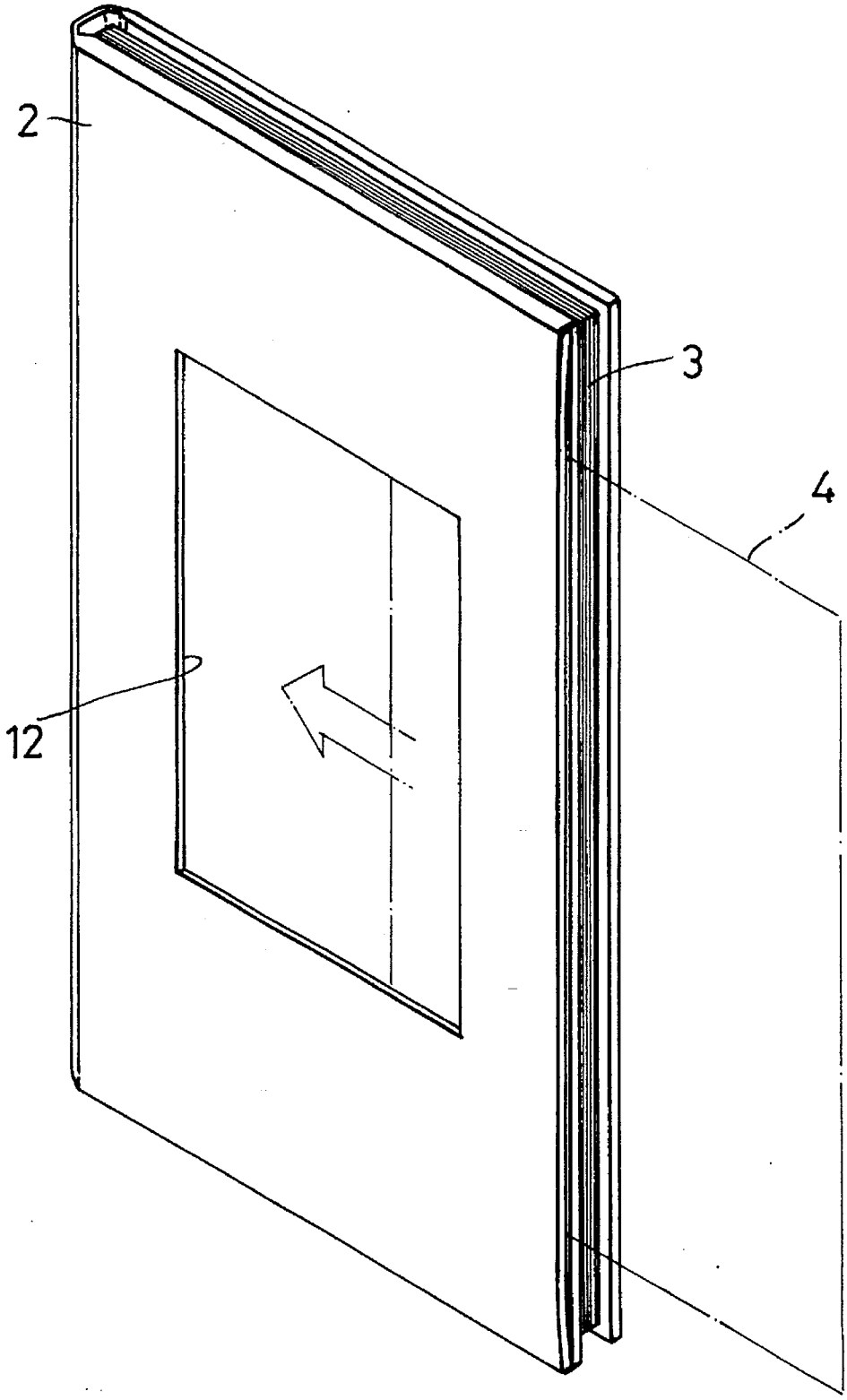
FIG. 5 is a perspective view of the first embodiment of a frontcover mountable with a photograph in the present invention, showing it used in a book and a photograph being inserted in the frontcover; and, FIG. 6 is a perspective view of a second embodiment of a frontcover mountable with a photograph in the present invention, showing it used in a book.

A first embodiment of a frontcover mountable with a photograph for books and its manufacturing method in the present invention, as shown in FIGS. 1–6, is manufactured by eight steps described as follows.

The first step is to prepare a proper size of a hard board. 1 being cut incompletely with a center vertical line 11 so as to be folded one (first) half on another (second) half.

The second step is to cut out an opening 12 of a rectangular, square, oval, etc. shape nearly in the center portion of the first half of the hard board 1.

The third step is to adhere a background paper with a beautiful design on an inner side of the second half of the hard board 1.

The fourth step is to cut off an opening 21 in a cover paper 2, a little smaller than but having a shape corresponding to the opening 12 of the first half of the hard board 1.

The fifth step is to make cuts 22 at four corners of the opening 21 of the cover paper 2, and to form a plurality of foldable portions 23.

The sixth step is to fold the foldable portions 23 over the edges of the opening 12 onto an inner surface of the first half of the hard board 1.

The seventh step is to adhere the foldable portions 23 already folded on the half of the hard board 1 closely.

The eighth step is to adhere the inner side of the cover paper 2 on the outer side of the half of the hard board 1, leaving one of any sides unadhered so as to form an entrance for a photograph to be inserted through and also through the gap unadhered between the cover paper 2 and the hard board 1 and exposed out of the opening 12.

A frontcover made according to the 8 steps of the manufacturing method above described can be combined with plural inner pages to become a book. A user may insert a photograph 4 properly cut through the gap between the cover paper 2 and the hard board 12 and let it exposed out of the opening 12. Then this book looks like something different from common books, having a particular and unique feature.

Figure 6:
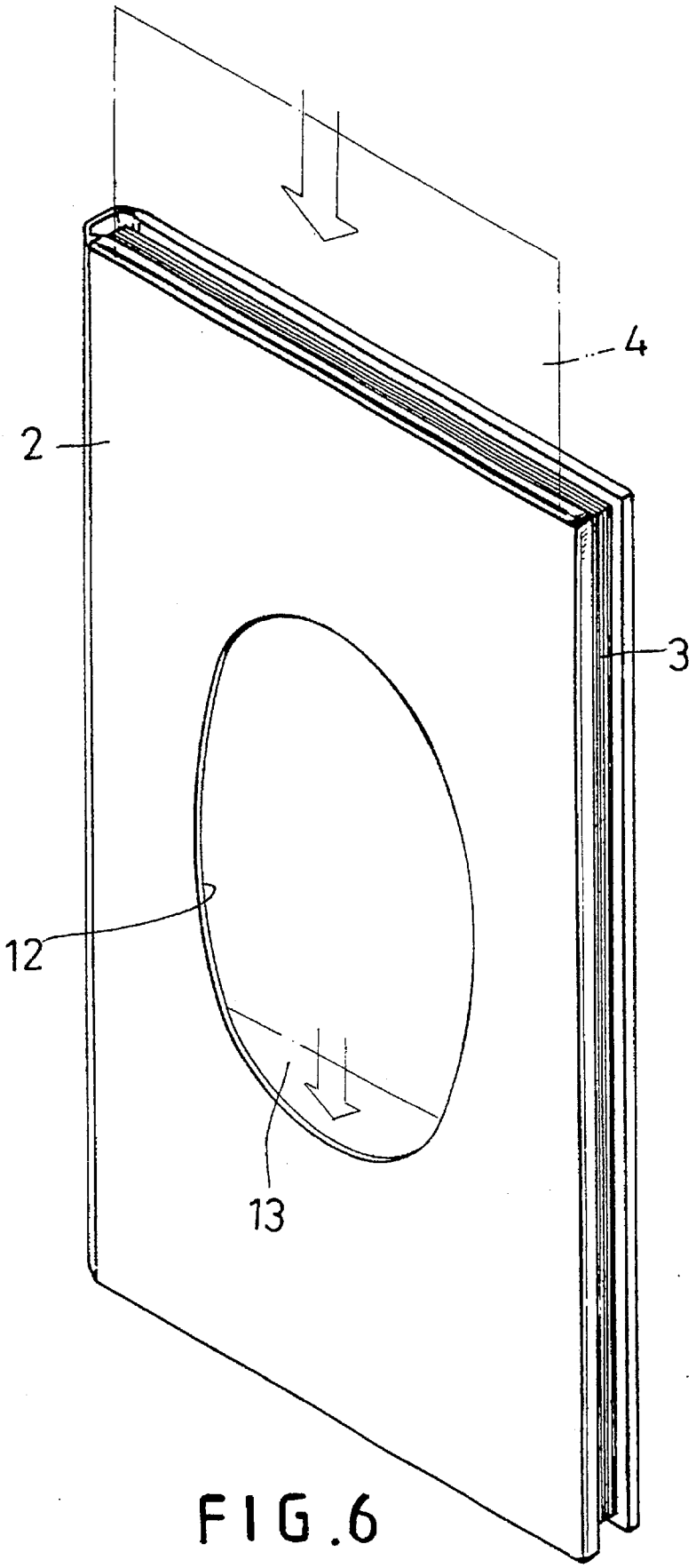

A second embodiment of a frontcover mountable with a photograph is shown in FIG. 6, having an opening 12 shaped as oval instead of rectangular in the first embodiment. And all the manufacturing method is the same as the first one.

While the preferred embodiments of the invention have been described above, it will be recognized and understood that various modifications may be made therein and the appended claims are intended to cover all such modifications which may fall within the spirit and scope of the invention.

What is claimed is:

1. A frontcover mountable with a photograph for books and its manufacturing method, said frontcover being made to have an opening for a photograph to expose out thereof after inserted through an entrance of an unadhered side of the frontcover adhered with a cover paper according to eight steps of the manufacturing method comprising:

a first step: cutting incompletely a center vertical line on a hard board cut properly so as to permit said hard board folded with a first half on a second half at said center vertical line to form a slight gap between said two halves folded on each other;

a second step: cutting out an opening in said first half of said hard board, said opening located at a proper place of said first half;

a third step: adhering a beautiful background paper on an inner side of said second half;

a fourth step: cutting out an opening in a cover paper to be adhered on an outer side of said first half, said opening being a little smaller than that of said opening of said first half of said hard board but corresponding to the shape of said opening of said first half;

a fifth step: cutting plural short cuts at four corners of said opening of said cover paper to form plural foldable portions;

a sixth step: placing said cover paper on the outer side of said first half of said hard board and folding said foldable portions over edges of said opening of said first half onto the inner side of said first half;

a seventh step: adhering inner sides of said folded portions on said inner side of said first half of said hard board; and an eighth step: adhering an inner side of said cover paper on the outer side of said first half of said hard board, leaving an unadhered side with an entrance for inserting a photograph therethrough to be exposed out of said opening of said first half of said hard board.

* * * * *